US008968165B2

(12) United States Patent
Becker

(10) Patent No.: US 8,968,165 B2
(45) Date of Patent: Mar. 3, 2015

(54) STRUCTURE FOR SECURING WEIGHT PLATES

(76) Inventor: Hermann Josef Becker, Trier (DE)

( * ) Notice: Subject to any disclaimer, the term of this patent is extended or adjusted under 35 U.S.C. 154(b) by 419 days.

(21) Appl. No.: 13/421,577

(22) Filed: Mar. 15, 2012

(65) Prior Publication Data

US 2012/0238416 A1 Sep. 20, 2012

(30) Foreign Application Priority Data

Mar. 15, 2011 (DE) ..... 10 2011 013 859

(51) Int. Cl.
*A63B 21/072* (2006.01)

(52) U.S. Cl.
CPC ..... *A63B 21/0728* (2013.01)
USPC ..... 482/107; 482/108

(58) Field of Classification Search
CPC ..... A63B 21/0728; A63B 21/072
USPC ..... 482/92–109
See application file for complete search history.

(56) References Cited

U.S. PATENT DOCUMENTS

| | | | | |
|---|---|---|---|---|
| 5,839,997 | A * | 11/1998 | Roth et al. | 482/107 |
| 7,507,189 | B2 * | 3/2009 | Krull | 482/98 |
| 7,517,305 | B2 * | 4/2009 | Lien | 482/106 |
| 7,553,265 | B2 * | 6/2009 | Crawford et al. | 482/108 |
| 7,614,982 | B2 * | 11/2009 | Crawford et al. | 482/107 |
| 7,794,373 | B2 * | 9/2010 | Crawford et al. | 482/107 |
| 7,803,095 | B1 * | 9/2010 | LaGree | 482/140 |
| 8,002,680 | B2 * | 8/2011 | Crawford et al. | 482/108 |
| 2006/0035767 | A1 * | 2/2006 | Ekhaus | 482/108 |
| 2007/0142188 | A1 * | 6/2007 | Lien | 482/93 |
| 2012/0115689 | A1 * | 5/2012 | Dalebout et al. | 482/107 |

* cited by examiner

*Primary Examiner* — Stephen Crow
(74) *Attorney, Agent, or Firm* — Marvin Petry; Stites & Harbison PLLC

(57) ABSTRACT

The means for securing weight plates (16) on weight rods (10', 12) or holder bars provides at least one groove (14) formed in an end region (10') of a weight rod (10', 12) or in the holder bar. The weight plates (16) are formed with a radial protrusion (17) in their central bore, preferably extending over only a portion of the circumference. The diameter of the bore at the protrusion (17) is greater than the diameter of the end region (10') of the weight rod (10', 12) or holder bar axially next to the groove (14). The protrusion (17) falls into the groove (14) and prevents the weight plate (16) from slipping off the weight rod (10', 12) or holder bar.

14 Claims, 7 Drawing Sheets

STRUCTURE FOR SECURING WEIGHT PLATES

The invention relates to structure for securing weight plates on a long weight rod grasped by both hands, on a dumbbell with a short weight rod or on a holder bar of exercise equipment or a rack, and to a weight plate for this kind of plate securing structure.

In high-quality weight rods, the two ends onto which the weight plates are placed are rotatably supported. To prevent the weight plates from falling off the rod, it is necessary to mount clamping locks, or even to screw nuts onto the rod. Since this entails considerable expense and loss of time, many athletes use the weight rods without securing them, thus running the attendant risks.

Depending on how they are embodied, weight rods weigh approximately 5 kg to 25 kg, for instance 5.5 kg, 7 kg, 17 kg, and so on. Thus there is not necessarily an integer weight number. If the weight rods are set down on the floor, it is difficult to replace weight plates of the same size as each other, since that would require lifting the weight rod by at least a few millimeters.

In fitness clubs, most of the weight rods are stored on support posts near bench presses, squat racks, and so forth. When weight plates are removed in order to change weights, the weight plates are initially not lifted; instead, they are simply pulled off the weight rod, so that only then does one have to bear the weight of the plates. In this way, the weight plates are sometimes unloaded from one side of the weight rod so far that it falls off the support post.

For securing weight plates, it is the object of the invention to form a long weight rod, a dumbbell with a short weight rod or a holder bar of exercise equipment or a rack and the associated weight plates in such a way that for avoiding the aforementioned risks, a lock is no longer required.

The above object is attained according to the invention by a structure for securing weight plates in which the weight rod or holder bar is provided with at least one circumferentially extending groove, and each weight plate is provided with a bore that on the bore wall has at least one radial protrusion that extends in the circumferential direction and is to be made to engage the groove, and the diameter of the bore at the protrusion is greater than the diameter of the weight rod or of the holder bar axially beside the groove.

The advantage of the invention is that the weight plates, as soon as they are placed on the weight rod or the holder bar, enter axially into positive engagement and cannot then fall, even if the weight rod is in a tilted position.

Some exemplary embodiments of the invention will be described below in detail. In the drawings.

Figure 1:
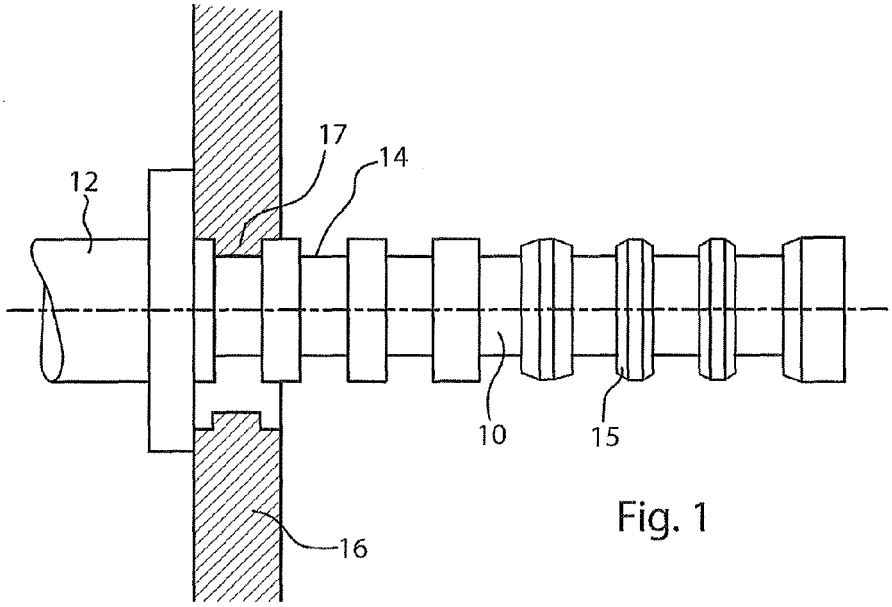
FIG. 1 shows a side view of the end region of a weight rod, with a plurality of grooves that extend all the way around, their outer edges being partly chamfered, and an axial cross section through the middle region of a weight plate placed on the weight rod.
Figure 2:
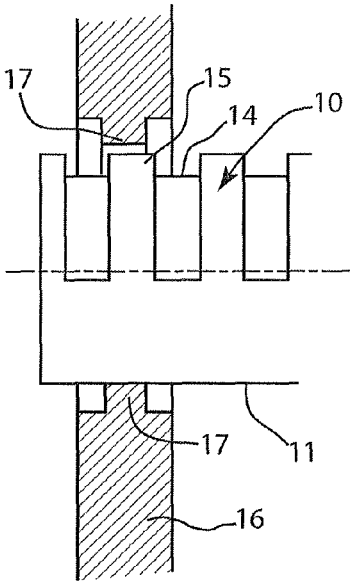
FIG. 2 shows a side view of an end region of a weight rod, with transverse grooves extending over only the upper part of the circumference, and an axial cross section through the middle region of a weight plate while it is being put on the rod.
Figure 7:
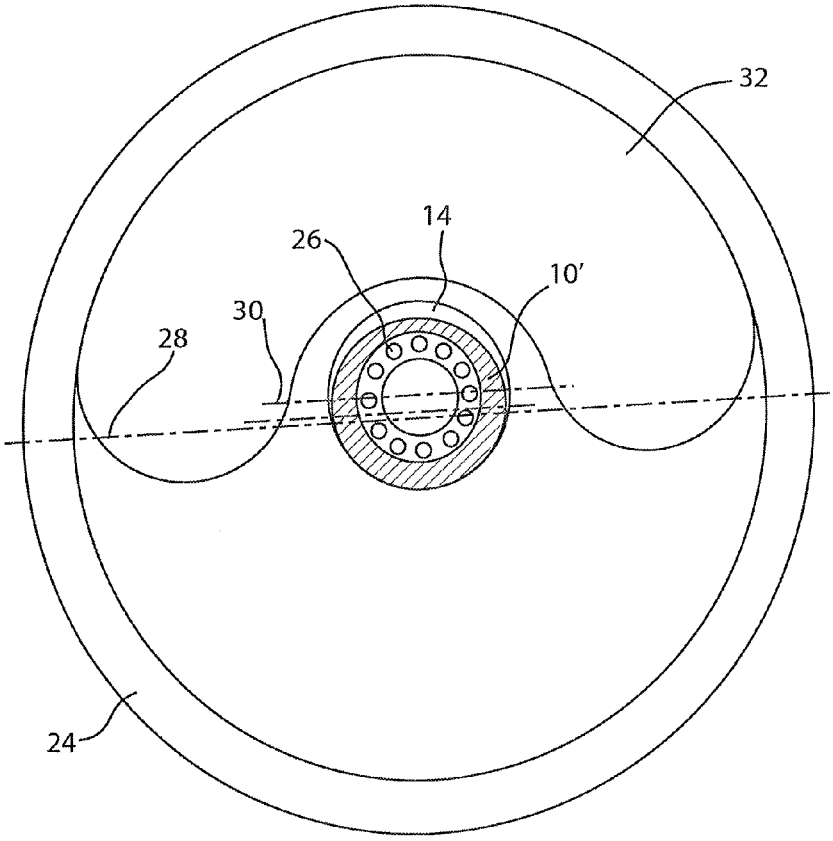
Figure 8:
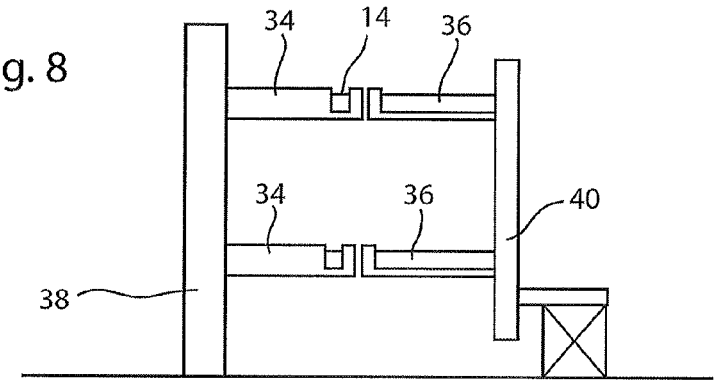
Figure 9:
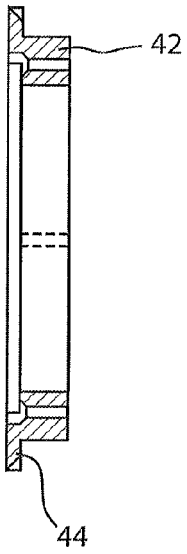
Figure 10:
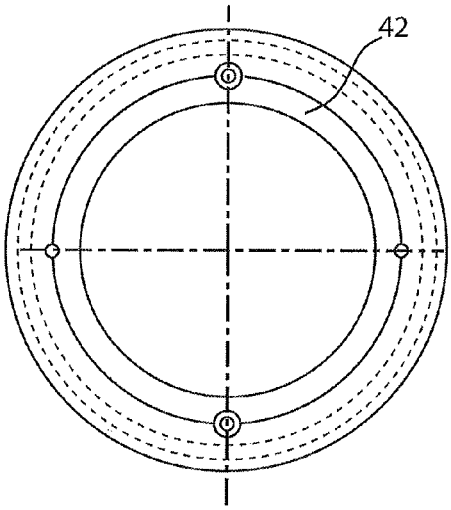
Figure 11B:
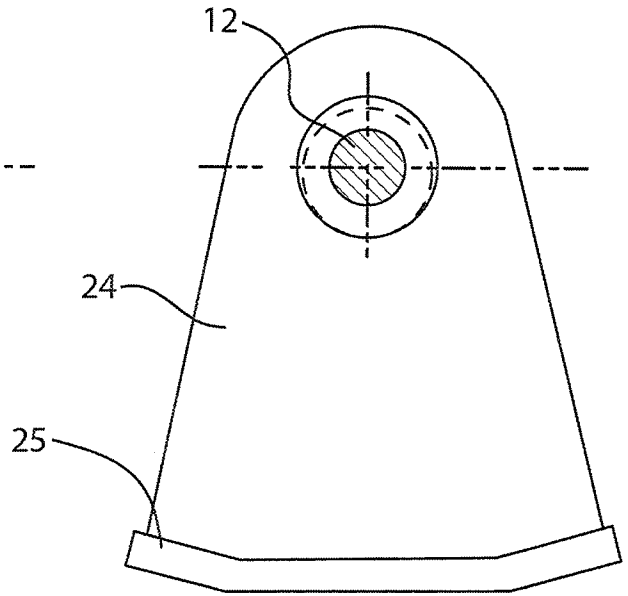
Figure 11A:
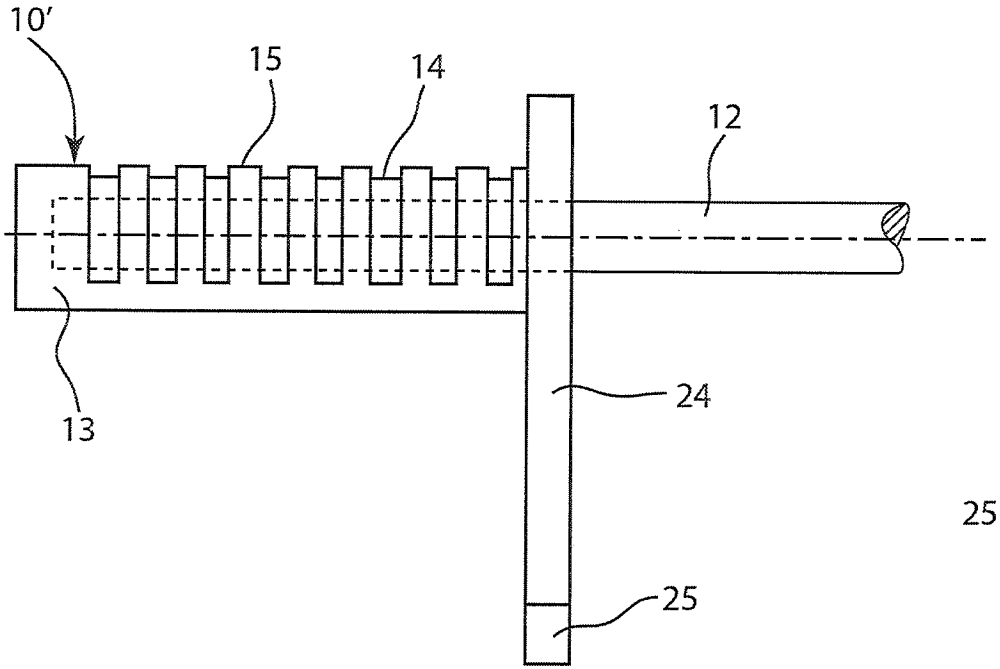
Figure 12B:
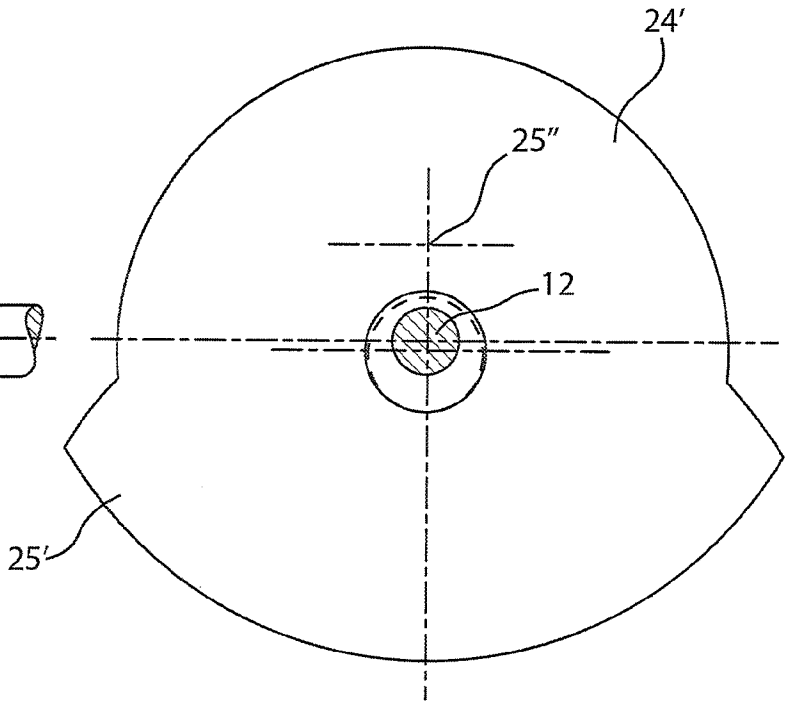
Figure 12A:
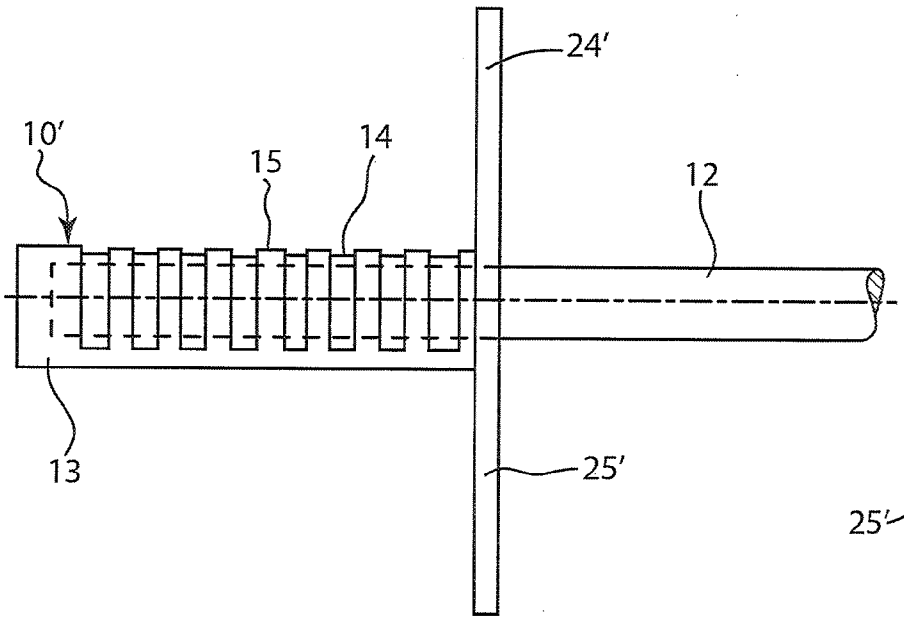
Figure 13:
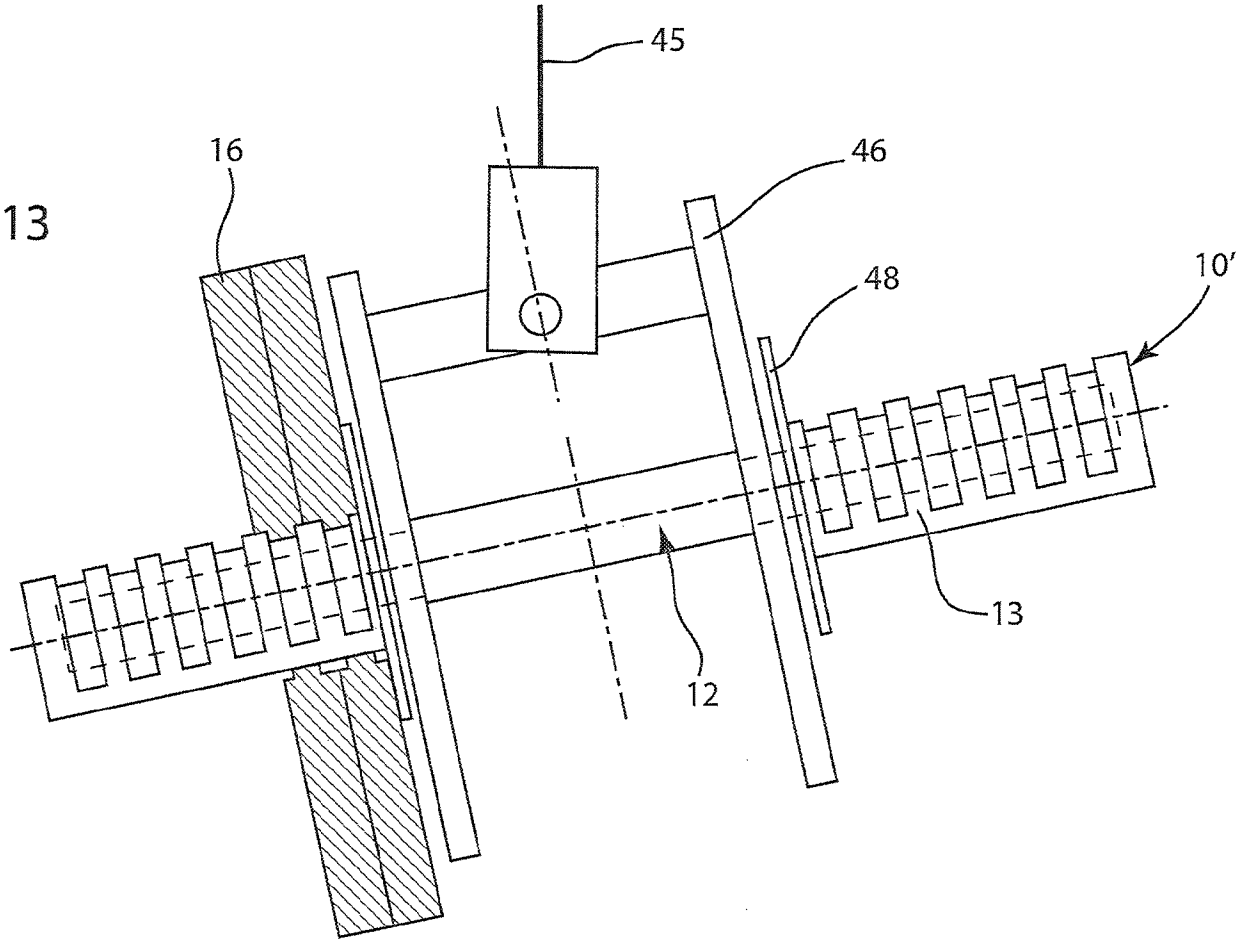

FIG. 7 is a radial cross section through an end region, supported rotatably on the weight rod and connected in a manner fixed against relative rotation to an adjusting weight plate that has an eccentric center of mass, the end region having transverse grooves extending over the upper part of the circumference, and in the rotary angle position shown, the center axis of the adjusting weight plate is aligned with the center axis of weight plates that are to be made to engage the transverse grooves;

FIG. 8 schematically shows both an upright rack member, having two holder bars for weight plates of different weights, and a piece of exercise equipment with two holder bars for receiving the weight plates;

FIGS. 9 and 10 show an axial cross section and a side view of an axial half of a hard plastic ring that can be inserted into a bore, which has been machined without a protrusion, in a weight plate of the kind shown in FIG. 1 or FIG. 2, in order to line the bore and to form the protrusion;

FIGS. 11A and 11B show a side view and a radial cross section of a weight rod with an adjusting weight in the form of a foot supporting the weight plates with a predetermined distance above the floor;

FIGS. 12A and 12B show a side view and a radial cross section of a weight rod with a modified foot for supporting the weight plates with a predetermined distance above the floor, and FIG. 13 shows a side view of a suspended dumbbell hanging on a rope.

The simplest version is shown in FIG. 1. Grooves 14 (plunge cuts) are cut into the end regions 10 of the weight rod 12 by turning. A weight plate 16, which in its central bore is provided with a protrusion 17 extending all the way around and fitting into the grooves 14, is simply slipped onto the rod 10, 12 and then lowered. Via the protrusion 17, the weight plate 16 catches on a groove 14 of the rod 10, 12 and can no longer slip off the rod.

Figure 5:
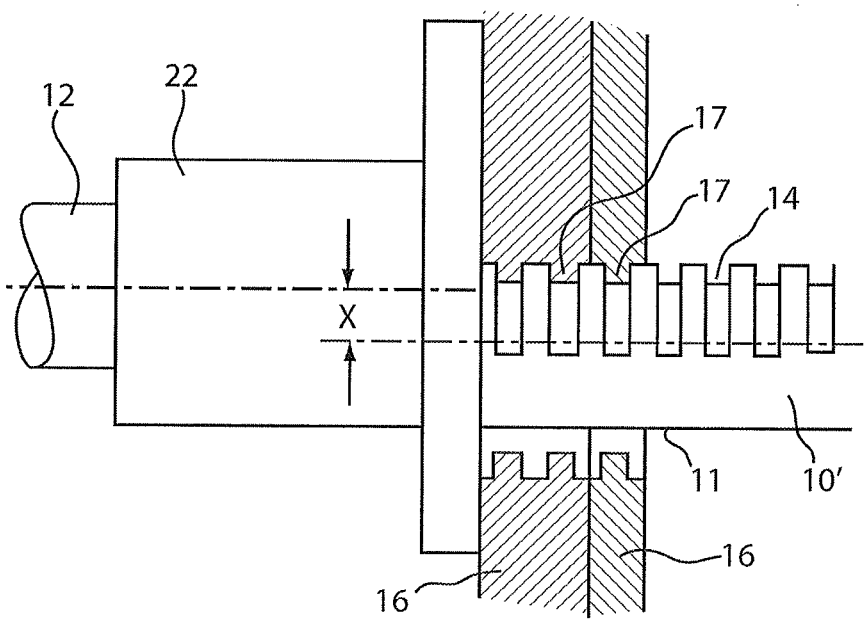
FIG. 5 shows a side view of a weight rod with an end region that is eccentrically rotatably supported and provided with transverse grooves extending over the upper part of the circumference, and an axial cross section through the middle region of two weight plates placed on the weight rod.

The spacings of the centers of the grooves correspond to the thicknesses of the weight plates 16. All the weight plates 16 are of the same thickness. As an alternative, in FIG. 5 narrower grooves 14 are shown, with two grooves 14 provided for one large weight plate 16 and one groove 14 provided for one small weight plate 16. Even narrower grooves 14 can be selected as well.

The weight plate receptacle in the end region 10 of the weight rod 12 shown in FIG. 1 is not rotatable relative to the grip region of the weight rod. In this weight rod 12, the weight plates 16 cannot be changed particularly easily, because over the entire circumference they repeatedly catch on the grooves 14. This problem is alleviated if, as shown on the right-hand side of FIG. 1, the edges of the lands 15 between the grooves 14 are chamfered. This makes it easier to change the weight plates 16.

Figure 3:
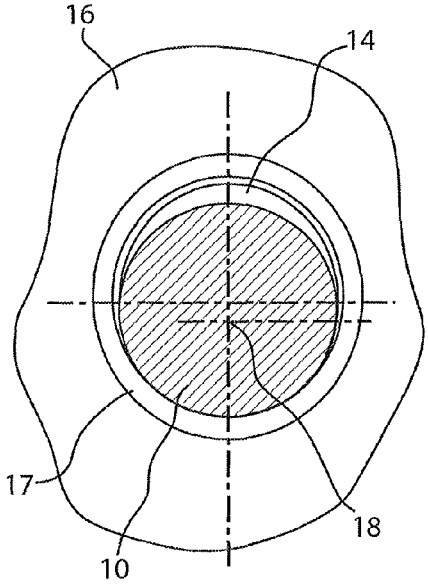
FIG. 3 is a radial cross section through the arrangement shown in FIG. 2.

In FIGS. 2 and 3, the grooves 14, in the form of turned plunge cuts, are created around an eccentric center axis 18, shifted downward, on only the upper half of the circumference of the end region 10 of the weight rod 12. To change the weights, the weight plate 16 is lifted until it touches the lower, smooth half 11 of the circumference of the end region 10, and then, in the position shown in FIGS. 2 and 3, it can be pulled off or slipped on without catching on anything.

Figure 4:
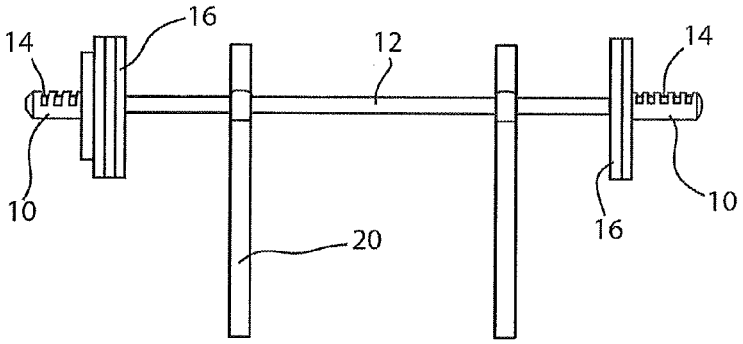
FIG. 4 shows a side view of a weight rod with several weight plates on its end regions, lying on a support post.

The problem of falling off a support post 20, shown for instance in FIG. 4, when the weight plates 16 are being unloaded from only one side is solved as well. Once the weight rod 12 on the support post 20 has already been largely unloaded on one side, and the next weight plate 16 is lifted in order to set it down, the now lightweight end of the rod 12, on the right in FIG. 4, swivels upward, so the next weight plate 16 cannot come loose from the grooves 14 and be removed. Thus it is possible to feel that the rod 12 is about to fall, in time to prevent that from happening.

If the grooves 14 are provided only at the top, as shown in FIGS. 2 and 3, then if possible they should always stay at the top. For that purpose, in FIG. 5 the plate holder bar 10' that forms the end region 10 is supported rotatably via a rotary bearing 22 and is eccentrically offset from the grip region of the weight rod 12 by the amount x. By the weight of the holder bar 10' itself and the weight of the weight plates 16 slipped onto it, the holder bar 10' always drops downward into the position shown in FIG. 5, in which the grooves 14 are located at the top.

Figure 6:
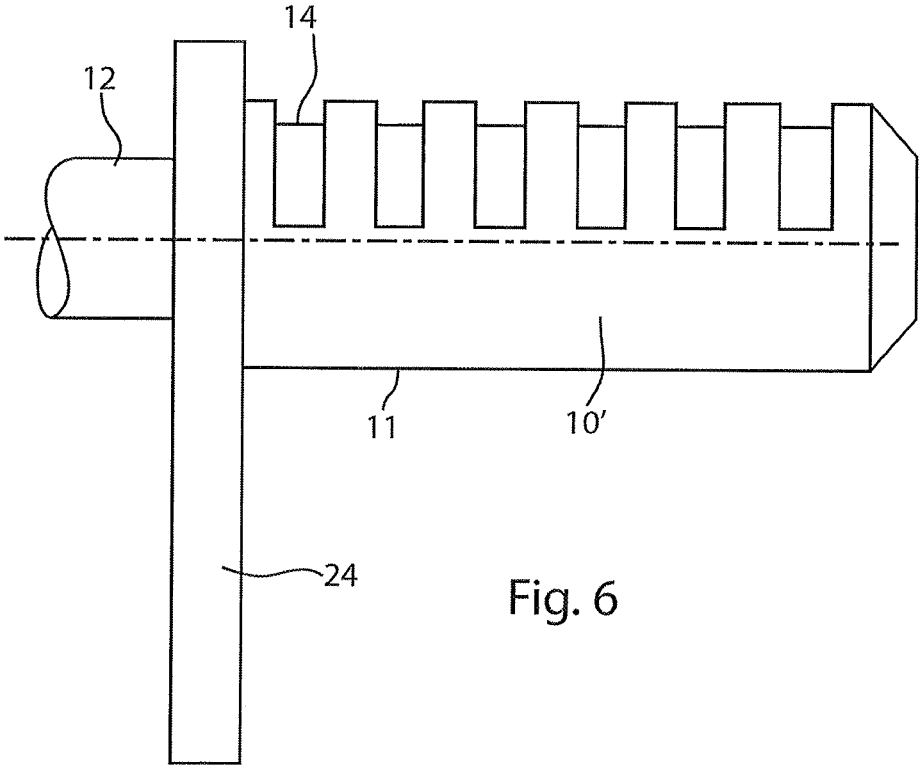
FIG. 6 shows a side view of a concentrically rotatably supported end region of a weight rod, which region is connected to an adjusting weight that has an eccentric center of mass.

In FIG. 6, the weight holder bar 10' is aligned with the central longitudinal axis of the weight rod 12. This bar 10' is likewise supported rotatably on the grip region of the rod 12 and is connected, in a manner fixed against relative rotation, to an eccentrically mounted adjusting weight 24. The mass of this weight 24 drops downward and rotates the weight holder bar 10' in such a way that the grooves 14 are at the top. The adjusting weight 24 can be embodied arbitrarily, but its center of mass must be located opposite the grooves 14. It is possible to combine the eccentricity x of FIG. 5 and an adjusting weight 24 with an eccentric center of mass in accordance with FIG. 6 for turning and maintaining the grooves 14 in the position at the top side of the weight holder bar 10'.

In FIG. 7, the adjusting weight 24 is in the form of a circular plate with an eccentric center of mass and is likewise solidly connected to the holder bar 10' that is supported concentrically on the weight rod 12 by ball bearings 26. However, in the position shown, in which the grooves 14 are located at the top, the center point of the adjusting weight plate 24 is a few millimeters below the center of the weight rod 12 and of the holder bar 10'. The eccentricity is preferably the same as the plunge-cut depth of the grooves 14, plus the difference in the radii of the central hole in the weight plates at the protrusion 17 and of the holder bar 10' at the lands 15 (corresponding to the small gap between protrusion 17 and land 15 in FIG. 2). On these preconditions, the adjusting weight plate 24 and the weight plates 16 are seated concentrically on the end regions 10 of the weight rod 12. The horizontal center line of the adjusting weight plate 24 and of the weight plates 16 that are seated on the holder bars 10' is identified in FIG. 7 by reference numeral 28. The horizontal center line of the holder bar 10' and of the grip region of the weight rod 12 is shown at 30. The spacing between the two center lines 28 and 30 amounts to only approximately 4 mm and is not visually obvious. The eccentricity of the center of mass of the adjusting weight plate 24 is achieved, in the exemplary embodiment of FIG. 7, by means of a relatively large recess 32 in the plate, extending over approximately half the circumference, which makes this half of the circumference lighter in weight than the solid half of the circumference shown at the bottom in FIG. 7. Thus the embodiment of FIG. 7 is a combination of an eccentricity of the total weight 16 (x=distance between 28 and 30) and an eccentric adjusting weight 24.

Preferably, the weight of the adjusting weight plates 24 is selected such that the total weight of the weight rod is a round number, such as 10, 15, 20, or 25 kg. It is favorable if the outer diameter of the adjusting weight plates 24 is equal to or a little bit greater than that of the largest weight plate 16 provided. Even on a weight rod 12 that is resting on the floor, weight plates 16 of equal size can then easily be slipped on and removed, since each needs to be lifted only slightly, one at a time, and then lowered. If the weight rod 12 with the weight plates 16 is set down on the floor, it likewise tends to orient itself in such a way that the grooves 14 are at the top.

As FIG. 8 shows, the proposed means for securing weight plates can also be used for designing the holder bars 34 and 36 of upright rack members 38 or of pieces of exercise equipment 40. In such applications, even if the holder bars 34, 36 are used for receiving many weight plates 16, they can be designed more simply than the ends of weight rods, since there is no danger that they can become tilted so that the weight plates 16 would slide off. It therefore suffices if, in the example of the holder bar 34, there is a single groove 14 before the free end, or in the example of the holder bar 36, a groove 14 extending over almost the entire length of the holder bar extends to just before the free end of the holder bar. The holder bars 34 and 36 can be brought into alignment, so that the weight plates can be slipped from one holder bar 34, 36 to another across a relatively small intermediate spacing.

In terms of view to their expense and for the sake of their holding their value, it is recommended that the weight plates 16 be made of steel, with a straight through bore in the center. These steel plates are encased in a coating of rubber or a rubberlike plastic, and this casing extends toward the central bore by approximately 2 to 3 mm. In the bore, two rings 42 of the type shown in FIGS. 9 and 10 are then put together in mirror symmetry and are screwed together axially in such a way that the flange 44 shown is in each case located axially on the outside. After assembly, the rings 42, joined together by four screws, form the protrusion 17, shown in FIGS. 1 and 2, of the weight plate 16. In a weight plate 16 that is 20 mm wide, for example, the protrusion 17 has a width of 16 mm, for example. Each ring 42 contributes to this with its width of 8 mm each. The flanges 44 are located on the face ends of the steel core of the weight plate 16; at the edge of the bore, this steel core is not encased in rubber. The rings 42 are under greater mechanical stress than the casing. They are therefore made of a hard, wear-resistant plastic.

FIG. 11A, B show an embodiment with an adjusting weight 24 (another one is at the other end of the weight rod 12) having a second function. It does not only contribute to rotate the weight holder bar 10' in such a way that the grooves 14 are at the top, as described in connection with FIG. 6, but when dropped downward also serves as foot 25 on which the weight rod 12 can be placed on a floor. It is so long that in this position there is a distance between the weight plates 16 and the floor so that it is easy to remove or exchange weight plates without having to lift the weight rod. As mentioned before, additionally the rotatable weight holder bar 10' could be mounted eccentrically on the grip portion of the weight rod 12.

A similar embodiment is shown in FIG. 12 A, B. It is a modification of FIG. 7 insofar as a disk 24' on the side of its center of mass is formed as a foot 25' with a greater radius having its center 25" offset in relation to the longitudinal axis 30 of the weight rod 12 to the opposite side of the foot 25'. The foot 25' provides an adjusting weight 24 with an eccentricity of the mass which can be enlarged in accordance with FIG. 7. In addition to this function the circular plate 24' with the round foot 25' allows for placing the weight rod 12 on the floor while keeping the weight plates 16 above the floor so that they also can be removed or exchanged without having to lift the weight rod.

As can be seen from FIGS. 11B and 12B the feet 25 and 25' are inclined or curved so that their ends are on a greater radius in relation to the longitudinal axis of the weight rod 12 than their middle portion and point upward. This has the effect that when lowering the weight rod 12 to the floor the ends of the feet 25, 25' do not cause damage and after placing the weight rod 12 on the floor there is a tendency to roll the feet into their normal position shown in FIGS. 11B and 12B. In order to ensure that the grooves 14 are always located at the top of the weight holder bar 10' the latter is mounted rotatably and eccentrically on the weight rod 12 and is fixedly connected to the foot disk 24'.

FIG. 13 shows one dumbbell of a pair of dumbbells, each being suspended at the lower end of a rope 45 hanging from a gallows-like piece of exercise equipment. The lower end of the rope 45 is fixed to a bridge-like connecting member 46 that bridges the grip of the short weight rod 12 of the dumbbell. Both, the connecting member 46 and the end regions 10' are freely rotatable in relation to the grip portion of the dumbbell. In the hanging position shown in FIG. 13 the connecting member 46 is vertically above the short weight rod 12 and the weight of the weight plates 16 turns the eccentrically mounted end portions 10' into the rotary angle position in which the grooves 14, extending over only a portion of the circumference, are located on the top. When weight plates 16 of a dumbbell of FIG. 13 are exchanged its weight rod 12 normally will be more or less tilted but the means described above for securing the weight plates 16 on the weight rod prevent their falling off the end regions 10'. Straightening plates 48 assist because they hold the adjacent weight plates 16 exactly in a position transverse to the longitudinal axis of the weight rod 12 even if it is more tilted than 45°.

The invention claimed is:

1. A structure for securing weight plates on a long weight rod, on a dumbbell with a short weight rod or on a holder bar of a piece of exercise equipment or of a rack member, wherein the weight rod on its end regions or the holder bar is provided with at least one circumferentially extending groove, and each weight plate is provided with a bore which on the bore wall has at least one circumferentially extending radial protrusion to be brought into engagement with the groove, and the diameter of the bore at the protrusion is greater than the diameter of the weight rod or of the holder bar axially next to the groove.

2. The structure for securing weight plates as defined by claim 1, wherein the groove extends over only a portion of the circumference, such as half the circumference, of the weight rod or of the holder bar.

3. The structure for securing weight plates as defined by claim 2, wherein the bore wall in at least one weight plate is provided with two or more protrusions disposed axially side by side with a defined intermediate spacing, and the weight rod has grooves with the same intermediate spacing, fitting the width of the protrusions.

4. The structure for securing weight plates as defined by claim 2, wherein the spacing of the at least one protrusion from the axial end faces of each weight plate and the spacing of the grooves, fitting the width of the protrusion, in the weight rod are adapted to one another such that weight plates that with their protrusions engage adjacent grooves are seated directly beside one another on the weight rod.

5. The structure for securing weight plates as defined by claim 1, wherein outer edges of the lands between the grooves are chamfered or rounded.

6. The structure for securing weight plates as defined by claim 2, wherein the end regions of the weight rod that are provided with the grooves are rotatably connected to the grip region of the weight rod.

7. The structure for securing weight plates as defined by claim 6, wherein the end regions of the weight rod that are provided with grooves are supported eccentrically on the grip region of the weight rod, and the grooves extending over only a portion of the weight rod are located on the side pointing toward the central longitudinal axis of the grip region, so that they are rotatable into the position pointing upward by the weight of the weight plates seated on the weight rod.

8. The structure for securing weight plates as defined by claim 6, wherein the end regions of the weight rod that are provided with grooves are supported concentrically to the central longitudinal axis of the grip region and are each rotatable by a respective adjusting weight connected eccentrically and in a manner fixed against relative rotation to each end region, into the particular rotary angle position in which the grooves are located on the top.

9. The structure for securing weight plates as defined by claim 8, wherein the adjusting weight has the form of a circular disk having the diameter of the largest of the weight plates used, but with a distribution of mass that is uneven over the circumference, and each adjusting weight plate is connected eccentrically and in a manner fixed against relative rotation to a rotatably supported end region, provided with grooves, of the weight rod in such a manner that in the lowermost position of the center of mass of the adjusting weight plate, its center point is located on the central longitudinal axis of the weight plates that are seated on the end region of the weight rod and engaging the grooves.

10. The structure for securing weight plates as defined by claim 2, wherein the end portions of the weight rod comprise a bushing of plastic material fixedly seated on the circumference and being formed with the grooves.

11. The structure for securing weight plates as defined by claim 8, wherein the adjusting weight has the form of a foot for supporting the weight rod and the weight plates with a predetermined distance above the floor.

12. The structure for securing weight plates as defined by claim 9, wherein the adjusting weight in the form of a disk is formed on its circumference on the side of the center of mass with a curved foot the ends of which in the standing position extend upward to a greater radius than its middle portion in relation to the central longitudinal axis of the weight rod.

13. The structure for securing weight plates on a short weight rod of a suspended dumbbell as defined in claim 2, wherein the rotatably and eccentrically mounted end regions of the weight rod comprise straightening discs holding the adjacent weight plates transverse to the longitudinal axis of the weight rod.

14. A weight plate for a structure for securing weight plates as defined by claim 1, wherein it comprises steel with a coating of rubber or rubber-like plastic on its outer circumferential surface and on the end faces, and the bore in the steel plate is embodied without the protrusion, and a ring of hard plastic, comprising two axial parts connected to one another, is inserted axially fixedly into the bore and forms the protrusion.

* * * * *